US006827049B2

(12) United States Patent
Oh

(10) Patent No.: US 6,827,049 B2
(45) Date of Patent: Dec. 7, 2004

(54) WATER JACKET FOR CYLINDER HEAD

(75) Inventor: Chang-Seok Oh, Kyungki-Do (KR)

(73) Assignee: Hyundai Motor Company, Seoul (KR)

( * ) Notice: Subject to any disclaimer, the term of this patent is extended or adjusted under 35 U.S.C. 154(b) by 51 days.

(21) Appl. No.: 10/308,974

(22) Filed: Dec. 3, 2003

(65) Prior Publication Data

US 2003/0221641 A1 Dec. 4, 2003

(30) Foreign Application Priority Data

May 28, 2002 (KR) ..... 2002-29566

(51) Int. Cl.[7] ..... F02F 1/36
(52) U.S. Cl. ..... 123/41.82 R
(58) Field of Search ..... 123/41.82 R, 41.28, 123/193.5, 41.72

(56) References Cited

U.S. PATENT DOCUMENTS

| | | | | |
|---|---|---|---|---|
| 3,491,731 A | * | 1/1970 | Deutschmann et al. | 123/41.82 R |
| 4,284,037 A | * | 8/1981 | Kasting et al. | 123/41.72 |
| 4,690,104 A | * | 9/1987 | Yasukawa | 123/41.32 |
| 5,715,776 A | | 2/1998 | Seidl | |
| 5,758,608 A | | 6/1998 | Berger et al. | |
| 5,836,272 A | | 11/1998 | Sakurai | |
| 5,890,461 A | | 4/1999 | Iikura | |
| 5,970,926 A | | 10/1999 | Tsunoda et al. | |
| 5,975,033 A | | 11/1999 | Wada | |
| 5,975,105 A | | 11/1999 | Chang | |
| 6,101,994 A | | 8/2000 | Ichikawa | |
| 6,216,658 B1 | | 4/2001 | Pierro et al. | |
| 6,244,225 B1 | | 6/2001 | Takahashi et al. | |
| 6,363,893 B1 | | 4/2002 | Xin et al. | |

FOREIGN PATENT DOCUMENTS

EP 0784150 B1 7/1997

* cited by examiner

*Primary Examiner*—Tony M. Argenbright
*Assistant Examiner*—Hyder Ali
(74) *Attorney, Agent, or Firm*—Morgan Lewis & Bockius LLP

(57) ABSTRACT

The water jacket includes at least two exhaust ports configured to exhaust combusted gases from a cylinder. The water jacket also defines a lower path, an higher path, and a central path. The higher path is configured for circulating cooling fluid above the at least two exhaust ports. The lower path is configured for circulating cooling fluid below the at least two exhaust ports. Also, the central path fluidly couples the lower path to the higher path. The central path also separates the at least two exhaust ports from one another. The central path is also configured for circulating cooling fluid between said at least two exhaust ports. A restricted portion is formed in the lower path on one side of said central path. The restricted portion is configured to restrict flow through the restricted portion of the lower path, thereby forcing cooling fluid through the central path.

13 Claims, 4 Drawing Sheets

WATER JACKET FOR CYLINDER HEAD

FIELD OF THE INVENTION

The present invention relates to a water jacket for a cylinder head of an engine. More particularly, the present invention relates to a structure of a water jacket for a cylinder head.

BACKGROUND OF THE INVENTION

In order for an engine to correctly operate and perform efficiently, it must cool off heat generated by combustion and friction of its operating parts. In general, a water-cooled engine is equipped with a water jacket that circulates cooling fluid, such as cooling water, around the cylinder block and cylinder head of an engine. The circulating cooling water cools off any heat generated by operation of the engine.

Current water jackets for circulating cooling water about a cylinder head of an engine have a number of drawbacks. One such drawback is that they do not effectively cool the area in and around cylinders' exhaust ports. Accordingly, a water jacket that effectively cools the area in and around cylinders' exhaust ports would be highly desirable.

SUMMARY OF THE INVENTION

In accordance with one embodiment of the present invention, a water jacket for a cylinder head includes a restricted portion for reducing the flow in a lower path, such that cooling water flows from the lower path to a higher path through a control path. The restricted portion is disposed near to where the lower path meets with the central path.

Preferably, the water jacket has a restricted portion along a lower path near to where said lower path meets a central path. The restricted portion reduces the flow of cooling fluid through the lower path. The lower path and the higher path are substantially parallel to each other. Also, the central path is substantially parallel to a cylinder. The lower path and the higher path are substantially perpendicular to the central path. The lower path and the higher path are similar, but for the restricted portion. In a preferred embodiment, the restricted portion is an indentation in one side of the lower path. Also in a preferred embodiment, the lower path and the higher path define two boundary edges of two exhaust ports of a cylinder, while the central path separates said the exhaust ports.

According to another embodiment of the invention, a water jacket includes at least two exhaust ports configured to exhaust combusted gases from a cylinder. The water jacket also defines a lower path, an higher path, and a central path. The higher path is configured for circulating cooling fluid above the at least two exhaust ports. The lower path is configured for circulating cooling fluid below the at least two exhaust ports. Also, the central path fluidly couples the lower path to the higher path. The central path also separates the at least two exhaust ports from one another. The central path is also configured for circulating cooling fluid between said at least two exhaust ports. A restricted portion is formed in the lower path on one side of said central path. The restricted portion is configured to restrict flow through the restricted portion of the lower path, thereby forcing cooling fluid through the central path. In a preferred embodiment, the restricted portion is formed to one side of where the low portion meets the central portion. The restricted portion reduces the flow of cooling fluid through the lower path. The lower path and the higher path are substantially parallel to each other. Also, the central path is substantially parallel to a cylinder. The lower path and the higher path are substantially perpendicular to the central path. The lower path and the higher path are similar, but for the restricted portion. In a preferred embodiment, the restricted portion is an indentation in one side of the lower path. Also in a preferred embodiment, the lower path and the higher path define two boundary edges of two exhaust ports of a cylinder, while the central path separates said the exhaust ports.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
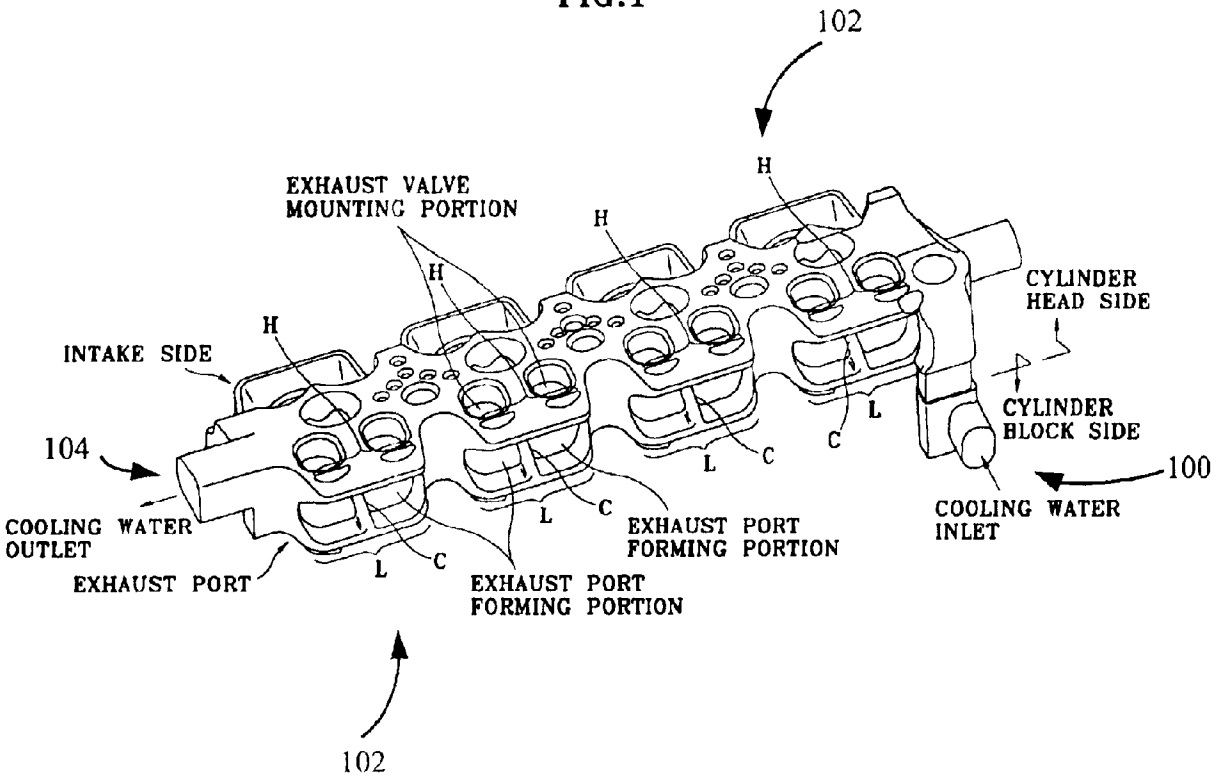
FIG. 1 illustrates a water jacket for a cylinder head.
Figure 2:
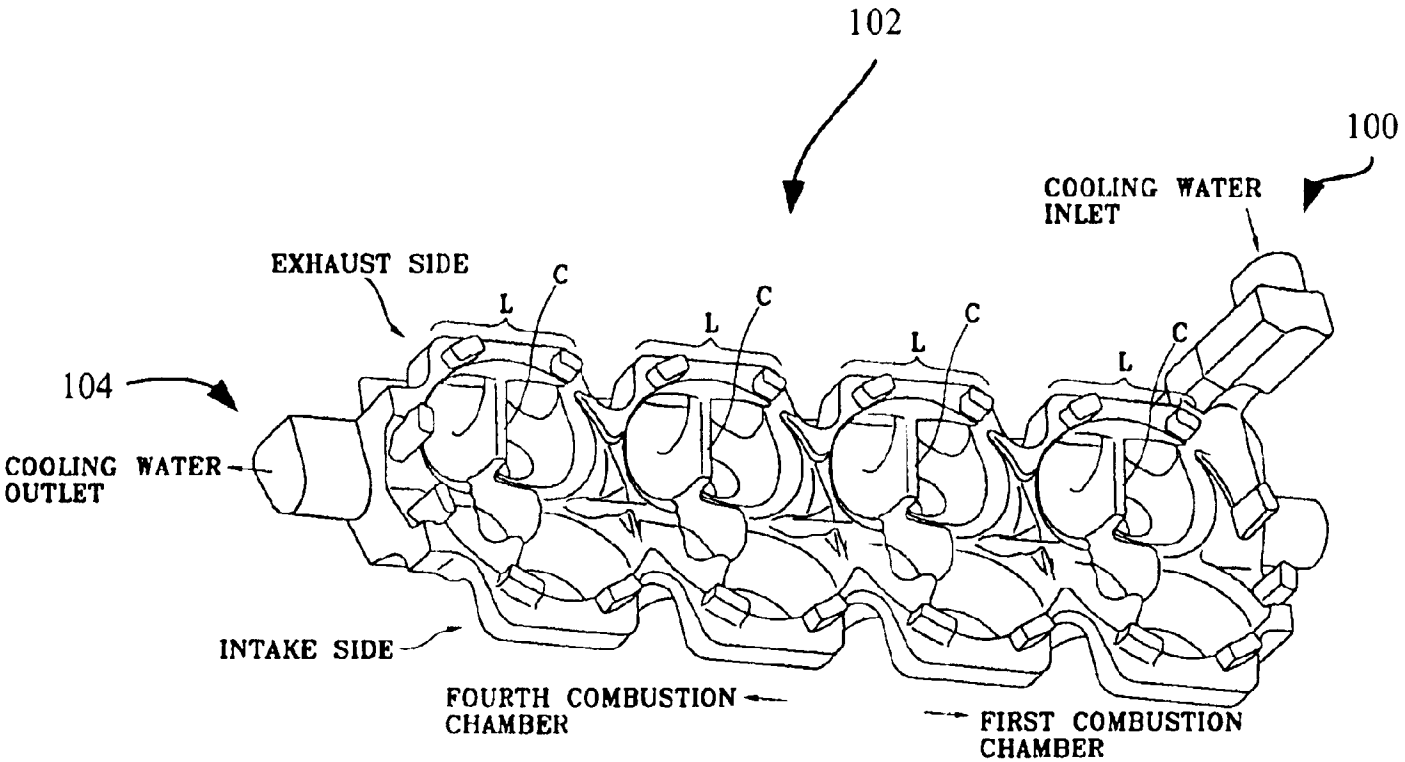
FIG. 2 illustrates a water jacket shown FIG. 1 as seen from the bottom.

As shown in FIGS. 1 and 2, in order to cool off combustion chambers arranged in a row, cooling water is introduced into a cooling water inlet 100 of a water jacket 102. The cooling water then flows through the first to fourth combustion chambers, and then drains out through a cooling water outlet 104. The shape of portion of the water jacket above each combustion chamber is generally identical, as they need to correspond with respective combustion chambers.

The design of exhaust ports is more complicated than that of intake ports since the high temperature of exhaust gas generated by the combustion chambers must be continuously removed through exhaust ports. Also, since the exhaust air within the cylinder is hotter than newly induced air, it is necessary to circulate cooling water more thoroughly and over a greater surface area, than is required for intake ports.

Because there are typically two exhaust ports, per cylinder and since heat is concentrated at a region between the two exhaust ports, it is important to effectively cool down this region between the exhaust ports. As a result, a central path (C) is formed between the two exhaust ports to circulate the cooling water therebetween. However, the central path (C) is constructed to guide cooling water in a vertical direction between a higher path (H) and a lower path (L), thereby making it difficult to smoothly circulate the cooling water. The higher path (H) guides the cooling water over the central path from the first combustion chamber to the fourth chamber, while the lower path (L) flows the cooling water under the central path from the fourth combustion chamber to the first chamber. In other words, the central path (C) guides the cooling water from the top to the bottom of the cylinder block. Since the direction of the higher path (H) relating to the inlet and that of the lower path (L) relating to the outlet are perpendicular to that of the central path (C), the cooling water within the central path (C) circulates based on the pressure difference between the upper and lower sides of the central path (C). The high and lower paths (H and L) shown in FIGS. 1 and 2 have a similar circulation, so that it is difficult to generate a pressure difference between the upper and lower sides of the central path (C). Therefore, the cooling water does not circulate smoothly through the central path (C), thereby failing to effectively cool down the region between the two exhaust ports.

Figure 3:
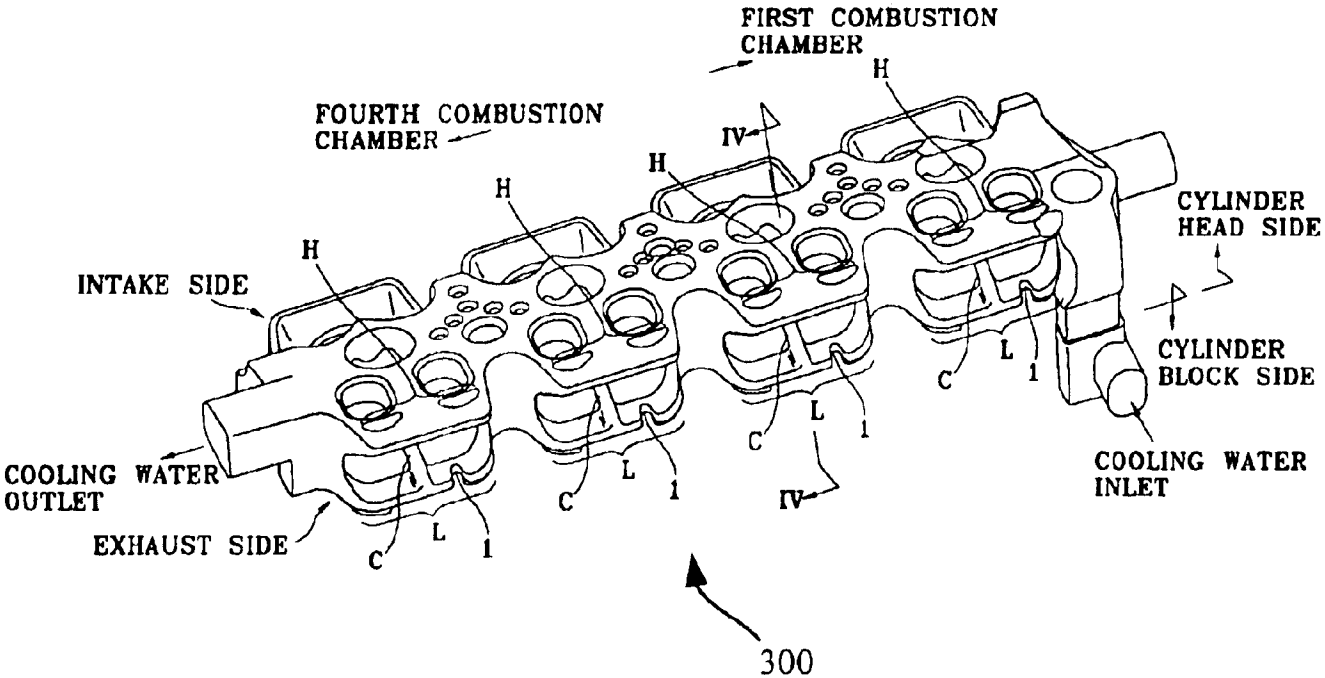
FIG. 3 illustrates a water jacket for a cylinder head in accordance with the present invention.
Figure 4:
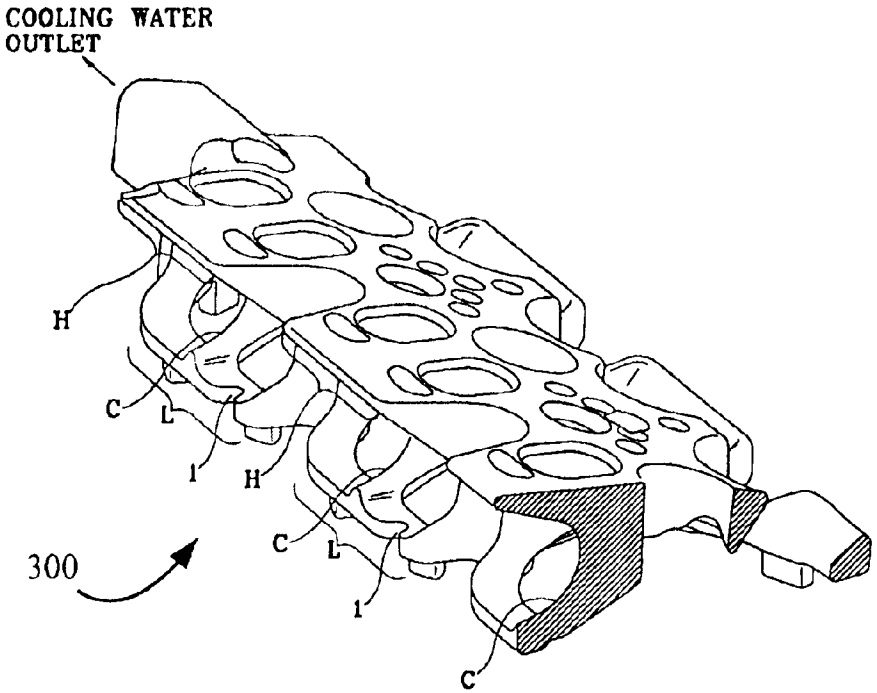
FIG. 4 illustrates a cross-section view taken along line IV—IV shown in FIG. 3.

As shown in FIG. 3, a water jacket 300 for a cylinder head includes identically-shaped portions above each combustion chamber, each of which is configured to cool down their respective combustion chambers. Each portion includes a higher path (H), a lower path (L) and a central path (C) vertically connecting the high and lower paths (H, L) at the cylinder head's exhaust ports. The lower path (L) has a restricted portion (1) which reduces the cross-section area through which coolant water can flow. The indented portion is located near to where the central and lower paths (C, L) meet.

In use, cooling water induced into the lower path (L) encounters an increased flow resistance at the restricted portion (1) as compared to flow of the cooling water flowing the higher path (H). Such flow resistance reduces flow through the restricted portion (1) of the lower path (L) more than the combined flow between the high and central paths (H, C).

The restricted portion (1) creates a pressure difference between the upper and lower sides of the central path (C), thereby circulating cooling water from the upper side of the central path (C) (high pressure) into the lower side (low pressure) thereof. In a preferred embodiment, the restricted portion (1) is only partially formed in the lower path (L) so as not to interfere with the cooling function of the lower path (L).

In conclusion, the restricted portion (1) is formed the lower path (L) to smoothly circulate the cooling water through the central path (C), thereby effectively cooling the portion between the exhaust ports where heat is concentrated.

The foregoing descriptions of specific embodiments of the present invention are presented for purposes of illustration and description. They are not intended to be exhaustive or to limit the invention to the precise forms disclosed. Obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A water jacket of a cylinder head, the jacket defining plural coolant flow paths, wherein said water jacket comprises:

a lower path;

a higher path; and a central path interconnecting said lower path with said higher path such that said lower path and said higher path are in fluid communication, and wherein said lower path defines a restricted portion disposed downstream of where said lower path meets said central path, said restricted portion being configured and dimensioned to create a pressure difference between upper and lower regions of the central path, thereby circulating coolant from the upper region of the central path into the lower region of the central path, and wherein said restricted portion is formed by an indentation in one side of said lower path.

2. The water jacket of claim 1, where said lower path and said higher path are substantially parallel to each other, said central path is substantially parallel to a cylinder, and said lower path and said higher path are substantially perpendicular to said central path.

3. The water jacket of claim 1, where said lower path and said higher path are similar, but for said restricted portion.

4. The water jacket of claim 1, where said lower path and said higher path define two boundary edges of two exhaust ports of a cylinder.

5. The water jacket of claim 4, where said central path separates said two exhaust ports.

6. A water jacket of a cylinder head, comprising:

at least two exhaust ports configured to exhaust combusted gases from a cylinder;

a higher path defined by said water jacket and configured for circulating cooling fluid above said at least two exhaust ports;

a lower path defined by said water jacket and configured for circulating cooling fluid below said at least two exhaust ports;

a central path defined by said water jacket, fluidly coupling said lower path to said higher path, where said central path separates said at least two exhaust ports from one another, and where said central path is configured for circulating cooling fluid between said at least two exhaust ports; and a restricted portion in said lower path on one side of said central path, where said restricted portion is configured to restrict flow through said restricted portion of said lower path, thereby forcing cooling fluid through said central path.

7. The water jacket of claim 6, wherein said restricted portion is formed to one side of where said low portion meets said central portion.

8. The water jacket of claim 6, where said lower path and said higher path are substantially parallel to each other, said central path is substantially parallel to a cylinder, and said lower path and said higher path are substantially perpendicular to said central path.

9. The water jacket of claim 6, where said lower path and said higher path are similar, but for said restricted portion.

10. The water jacket of claim 6, where said restricted portion is an indentation in one side of said lower path.

11. The water jacket of claim 6, where said lower path and said higher path define two boundary edges of two exhaust ports of a cylinder.

12. The water jacket of claim 11, where said central path separates said two exhaust ports.

13. A water jacket of a cylinder head, comprising:

a higher path;

a lower path;

a central path interconnecting said lower path with said higher path such that said lower path and said higher path are in fluid communication; and a restricted portion configured and dimensioned in said lower path, wherein said restricted portion is disposed adjacent to where said lower path couples with said central path, said restricted portion being configured and dimensioned to create a pressure difference between upper and lower regions of the central path thereby circulating coolant from the upper region of the central path into the lower region of the central path.

* * * * *